US006686683B2

(12) United States Patent
Ohtsuka et al.

(10) Patent No.: US 6,686,683 B2
(45) Date of Patent: Feb. 3, 2004

(54) COLOR CATHODE RAY TUBE

(75) Inventors: Futoshi Ohtsuka, Suita (JP); Kiyohito Miwa, Ikoma (JP); Hirotoshi Watanabe, Suita (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/439,600

(22) Filed: May 16, 2003

(65) Prior Publication Data

US 2004/0000856 A1 Jan. 1, 2004

(30) Foreign Application Priority Data

May 23, 2002 (JP) ..... 2002-148703

(51) Int. Cl.[7] ..... H01J 29/80
(52) U.S. Cl. ..... 313/402; 313/269
(58) Field of Search ..... 313/402, 404, 313/407, 269

(56) References Cited

U.S. PATENT DOCUMENTS

2001/0002352 A1 5/2001 Mizuta et al.

FOREIGN PATENT DOCUMENTS

| | | |
|---|---|---|
| EP | 1 089 311 | 4/2001 |
| JP | 2001-101978 | 4/2001 |
| JP | 2001-155654 | 6/2001 |

*Primary Examiner*—Vip Patel
(74) *Attorney, Agent, or Firm*—Merchant & Gould, P.C.

(57) ABSTRACT

A vibration damping member penetrates through two mounting apertures provided in a shadow mask with tension applied thereto, so as to be attached to the shadow mask in a freely movable state. The vibration damping member has two penetrating portions each passing loosely through one of the two mounting apertures and a bridge portion linking these portions. A protrusion protruding toward the shadow mask is provided in the bridge portion of the vibration damping member. This configuration regulates a tilted angle of the vibration damping member with respect to the face of the shadow mask, thus preventing a phenomenon in which a bending portion is caught by the edge of the mounting aperture so that the vibration damping member is pinned by the shadow mask. As a result, the freely movable state of the vibration damping member can be kept always, and therefore vibrations of the shadow mask can be dampened effectively and a color cathode ray tube with reduced color displacement can be provided.

8 Claims, 11 Drawing Sheets

COLOR CATHODE RAY TUBE

BACKGROUND OF THE INVENTION

1. Field of the Invention

The present invention relates to a color cathode ray tube used for a television receiver and a computer display.

2. Related Background Art

In recent years, in order to reduce reflections and provide a good appearance, a color cathode ray tube having a substantially flat face panel for displaying an image is becoming mainstream. Following this, a shadow mask that is disposed inside of the tube so as to oppose an inner face of the face panel tends to be supported in a state closer to a flat form than before. As the supporting method, a tension method is known in which a shadow mask is welded and fixed to a frame while applying tension to the shadow mask.

In the color cathode ray tube employing the tension method, various measures are taken for preventing color displacement generated due to vibration of the shadow mask, which is caused by the transmission of vibration of a speaker or the like. For example, JP 2001-101978 A discloses a technology for attaching a vibration damping member, which is formed in a frame form by bending, to a shadow mask so that the vibration damping member can move freely.

According to this technology, when the shadow mask vibrates, the vibration damping member moves independently of the shadow mask. As a result, the vibration energy of the shadow mask is converted into a friction energy between the vibration damping member and the shadow mask to be consumed, thus dampening the vibrations of the shadow mask. Also, such a vibration damping member can be formed easily and accurately.

However, the frame-form vibration damping member described in this prior art has the following problem: this vibration damping member exerts remarkable effects for suppressing the vibrations of the shadow mask if the vibration damping member always can be kept in a freely movable state. In this respect, as shown in FIG. 11, a bending portion 32*a* or 32*b* of a vibration damping member 31 tends to be caught by the edge of a mounting aperture 33 in the shadow mask 5, and once the vibration damping member 31 is caught so as to be pinned (i.e., latched and fixed) by the shadow mask 5, then it becomes impossible for the vibration damping member 31 to return to a freely movable state. This means that the effective vibration damping for the shadow mask 5 may not be achieved.

SUMMARY OF THE INVENTION

Therefore, with the foregoing in mind, it is an object of the present invention to provide a color cathode ray tube in which vibration of a shadow mask is dampened effectively by providing the color cathode ray tube with a vibration damping member attached so as to always keep a freely movable state.

In order to fulfill the above-stated object, a color cathode ray tube of the present invention has the following configurations.

That is, a color cathode ray tube according to the present invention includes: a shadow mask held in a state of tension applied thereto; two mounting apertures provided in the shadow mask or a different member attached to the shadow mask, the different member vibrating following vibration of the shadow mask; and a vibration damping member penetrating through the two mounting apertures to be attached in a freely movable state to the shadow mask or the different member, the vibration damping member dampening vibrations of the shadow mask.

In a first color cathode ray tube of the present invention, the vibration damping member has two penetrating portions each passing loosely through one of the two mounting apertures and a bridge portion linking the two penetrating portions. A protrusion or a swelling portion protruding toward the shadow mask or the different member is provided in the bridge portion.

In a second color cathode ray tube of the present invention, a protrusion or a swelling portion protruding toward the vibration damping member is provided at a region between the two mounting apertures of the shadow mask or the different member.

A third color cathode ray tube of the present invention further includes a member that has an aperture through which the vibration damping member penetrates and is attached in a freely movable state to the vibration damping member.

In a fourth color cathode ray tube of the present invention, the vibration damping member has two penetrating portions each passing loosely through one of the two mounting apertures, and the vibration damping member has an asymmetrical shape with respect to a center position between the two penetrating portions.

DETAILED DESCRIPTION OF THE INVENTION

According to the first through fourth color cathode ray tubes of the present invention, a freely movable state of a vibration damping member always can be maintained. Therefore, vibrations of a shadow mask can be dampened effectively, so that a color cathode ray tube with reduced color displacement can be provided.

The following describes embodiments of the present invention in detail, with reference to the drawings.

Figure 2:
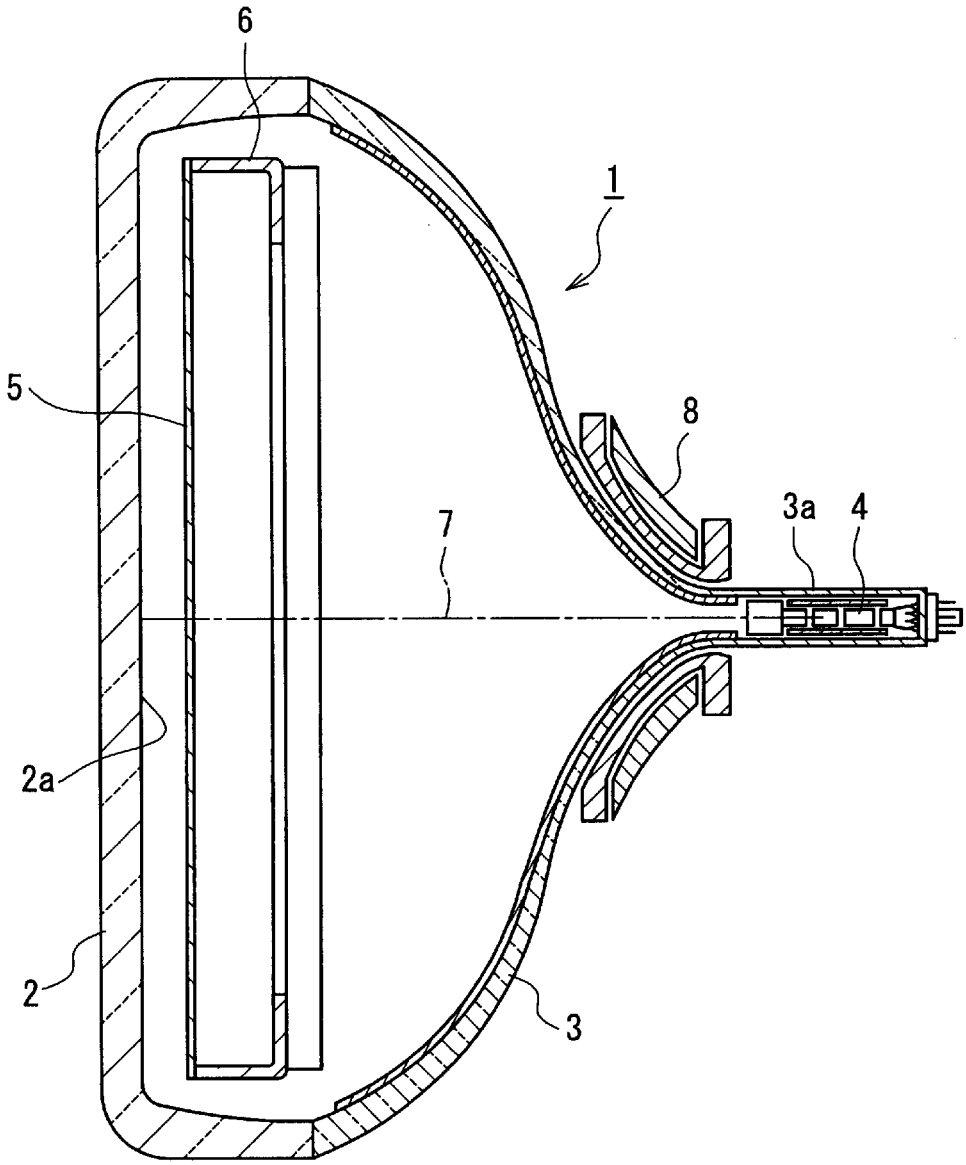
FIG. 2 is a schematic cross-sectional view of a color cathode ray tube according to one embodiment of the present invention.

FIG. 2 shows one example of the color cathode ray tubes. A color cathode ray tube 1 is provided with an envelope including a panel 2 having a phosphor screen 2*a* formed on its inner surface and a funnel 3. In a neck portion 3*a* of the funnel 3, an electron gun 4 is contained. A shadow mask 5 facing the phosphor screen 2*a* is supported by a mask frame 6, and the mask frame 6 is attached to panel pins (not illustrated) provided on an inner wall of the panel 2 through a spring (not illustrated). Furthermore, in order to deflect and scan an electron beam 7 emitted from the electron gun 4, a deflection yoke 8 is provided on the outside of the funnel 3.

Figure 3:
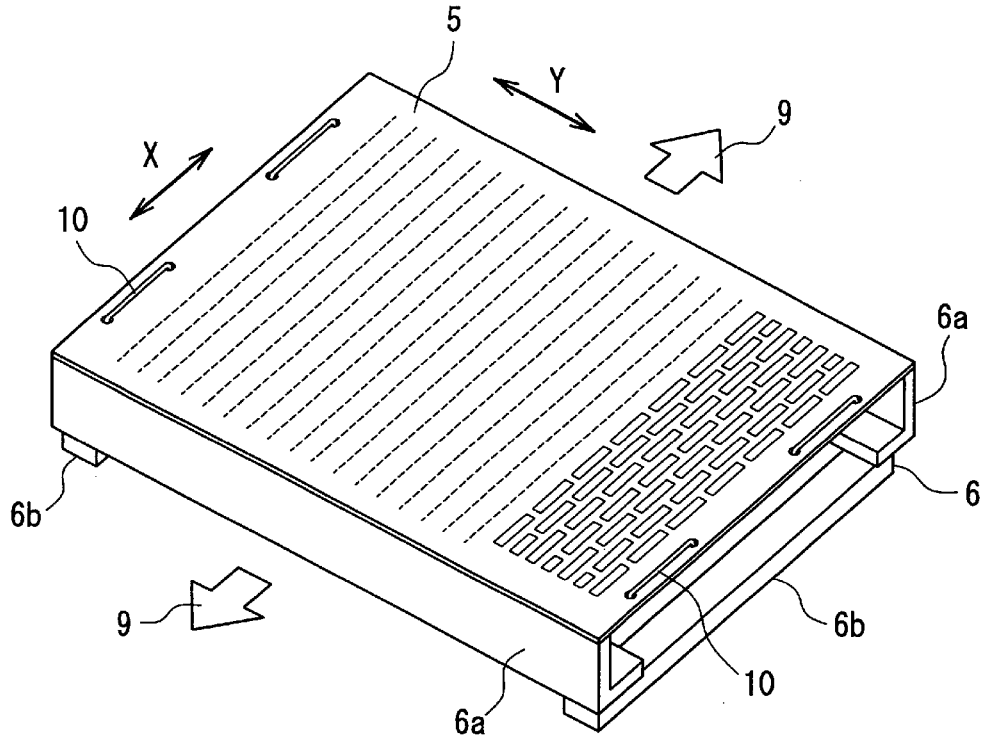
FIG. 3 is a perspective view showing an assembled member of a shadow mask of a color cathode ray tube according to one embodiment of the present invention.

FIG. 3 shows one embodiment of an assembled member of the shadow mask 5 and the mask frame 6 of the color cathode ray tube. The mask frame 6 is a rectangular frame member including a pair of long side frames 6*a* and a pair of short side frames 6*b*. The shadow mask 5 having a large number of apertures is welded to the long side frames 6*a* while applying tension to the shadow mask 5 in the direction of an arrow 9, i.e., in the vertical direction (X-axis direction). At end portions of the shadow mask in the direction perpendicular to the tension applying direction, i.e., in the horizontal direction (Y-axis direction), vibration damping members 10 are attached.

Embodiment 1

Figure 1:
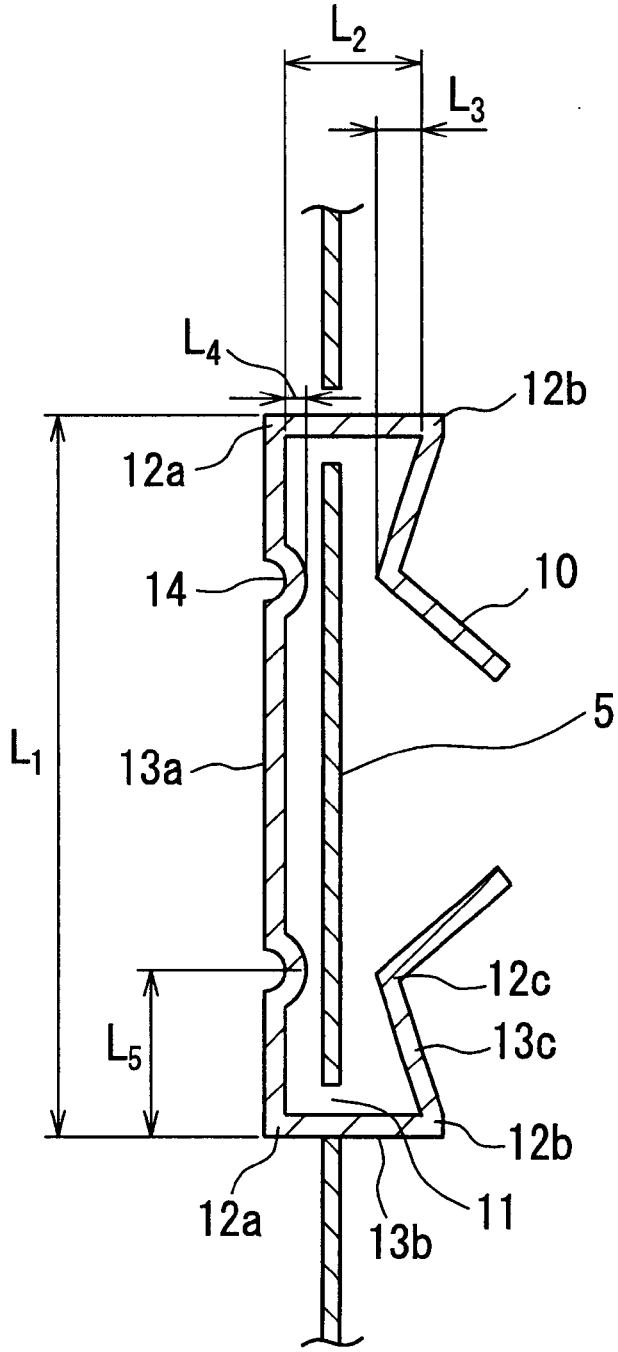
FIG. 1 is a cross-sectional view showing a vibration damping member and a shadow mask in a color cathode ray tube according to Embodiment 1 of the present invention.

FIG. 1 is a detailed partial cross-sectional view showing a state in which a vibration damping member 10 according to Embodiment 1 of the present invention is attached to a shadow mask 5. The vibration damping member 10 has a bridge portion 13*a* and two penetrating portions 13*b* that are bent with respect to the bridge portion 13*a* at bending portions 12*a* as both ends of the bridge portion 13*a*. After penetrating through two mounting apertures 11 that are provided in the shadow mask 5, the two penetrating portions 13*b* are bent at bending portions 12*b* toward the side of the bridge portion 13*a* and are bent again at turning portions 12*c* away from the bridge portion 13*a*. Since an outer diameter of the penetrating portions 13*b* is smaller than an aperture diameter of the mounting apertures 11 and a space between the two penetrating portions 13*b* is substantially equal to a space between the two mounting apertures 11, the vibration damping member 10 is attached to the shadow mask 5 so that the vibration damping member 10 can move freely with respect to the shadow mask 5. In this invention, "the freely movable state" of the vibration damping member 10 with respect to the shadow mask 5 means a state where, when the shadow mask 5 vibrates, the vibration damping member 10 can repeatedly make movements such as floating, colliding and bouncing with respect to the shadow mask 5, independently of the vibration of the shadow mask 5. Accordingly, this state is clearly different from a "fixed" and a "fastened" state in which the vibration damping member 10 cannot make a movement independently of the shadow mask 5 during the vibration of the shadow mask 5.

The bridge portion 13*a* is provided with two protrusions 14 protruding toward the shadow mask 5. These protrusions 14 keep the bridge portion 13*a* of the vibration damping member 10 offset (apart) from the shadow mask 5. This configuration regulates a tilted angle of the vibration damping member 10 with respect to the face of the shadow mask 5, thus preventing a phenomenon in which the bending portion 12*a* or 12*b* is caught by the edge of the mounting aperture 11 so that the vibration damping member 10 is pinned by the shadow mask 5.

A specific example of the present invention and its effects will be described below. As an example of the present invention, a wide-screen color cathode ray tube having a diagonal screen size of 76 cm, which employed the tension method, was prepared. In this color cathode ray tube, two vibration damping members 10 were attached at each side of the end portions of the shadow mask 5 in the horizontal direction. Each of the vibration damping members, which were made of SUS 430 with a wire diameter of 0.9 mm, penetrated through mounting apertures 11 with an aperture diameter of 1.4 mm. Referring to FIG. 1, a length L1 of a bridge portion 13*a* was 70 mm, a length L2 between bending portions 12*a* and 12*b* was 2.5 mm, a height L3 of the turned portion was 1.0 mm, a height L4 of protrusions 14 was 0.5 mm and a distance L5 between the bending portion 12*a* and the center of the protrusion 14 was 7.5 mm. Meanwhile, as a comparative example, a color cathode ray tube having the same size was prepared in which a vibration damping member having the same configuration as that of the above example, except for no protrusions 14 being provided and a bridge portion 13*a* formed in a substantially straight form, was attached to a shadow mask. The dimensions and the attached position in the comparative example were the same as in the above example.

As for these two color cathode ray tubes, at a position slightly displaced toward an edge in the horizontal direction from the midpoint between the center of the screen and the edge, where color displacement due to vibrations becomes more pronounced, (the coordinates of the position is (280, 0) (unit: mm) where the coordinates of the center of the shadow mask is (X, Y)=(0, 0)), the amplitude and the damping time of vibrations of the shadow masks were measured when the sound in a frequency band that makes the shadow masks vibrate the most remarkably (about 160 Hz) was given from a speaker. The results will be shown in Table 1:

TABLE 1

| | Maximum amplitude [μm] | Damping time [sec] |
|---|---|---|
| Example of the present invention | 61 | 2.9 |
| Comparative example | 105 | 8.8 |

From Table 1, it can be seen that the example of the present invention makes the maximum amplitude smaller and the damping time of the amplitude shorter than the comparative example.

Note here that although this embodiment was described referring to FIG. 1, which provides the protrusions 14 having a substantially arc shape in the bridge portion 13*a* of the vibration damping member 10, the shape of the protrusions is not limited to this example, and they may be formed in another shape, such as a triangle and a trapezoidal form.

Figure 4:
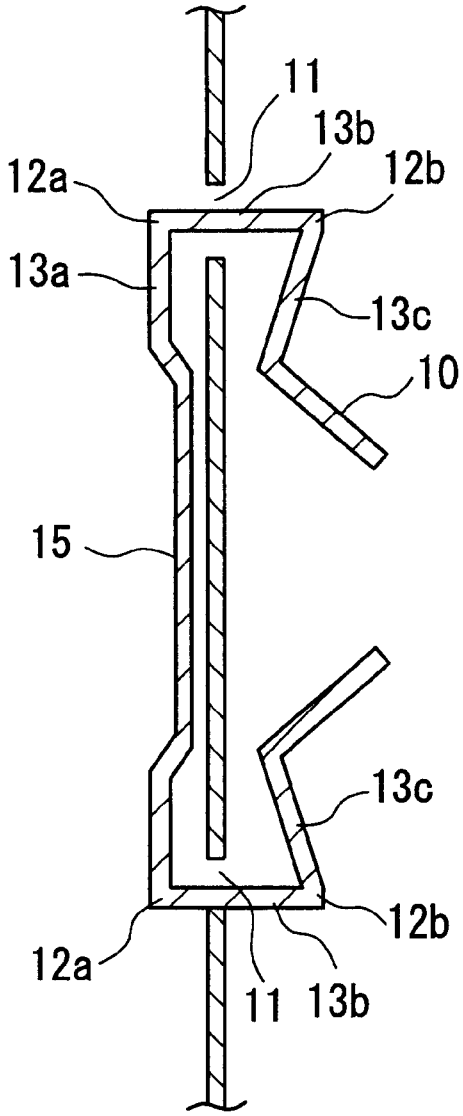
FIG. 4 is a cross-sectional view showing another configuration example of a vibration damping member and a shadow mask in a color cathode ray tube according to Embodiment 1 of the present invention.

Additionally, the number of the protrusions is not limited to two. Furthermore, as shown in FIG. 4, a swelling portion 15 having a certain degree of length may be provided in the bridge portion 13*a* of the vibration damping member 10. Moreover, the protrusions and the swelling portion need not be formed by deforming the material of the vibration damping member 10. Instead, they may be formed by attaching a different member to the bridge portion 13*a* of the vibration damping member 10.

In this embodiment, the bending angle at the bending portion 12*b* may be an angle in such a degree that the vibration damping member 10 would not drop from the shadow mask 5. However, it is preferable that, as shown in FIG. 1, the bending is carried out at the bending portion 12*b* so that a portion 13*c* positioned on the open end side from the bending portion 12*b* forms an acute angle with the penetrating portion 13*b*. With this configuration, the portion 13*c* also serves to regulate the tilted angle of the vibration damping member 10 with respect to the face of the shadow mask 5, thus further preventing a phenomenon in which the bending portion 12*a* or 12*b* is caught by the edge of the mounting aperture 11 so that the vibration damping member 10 is pinned by the shadow mask 5.

Embodiment 2

Figure 5:
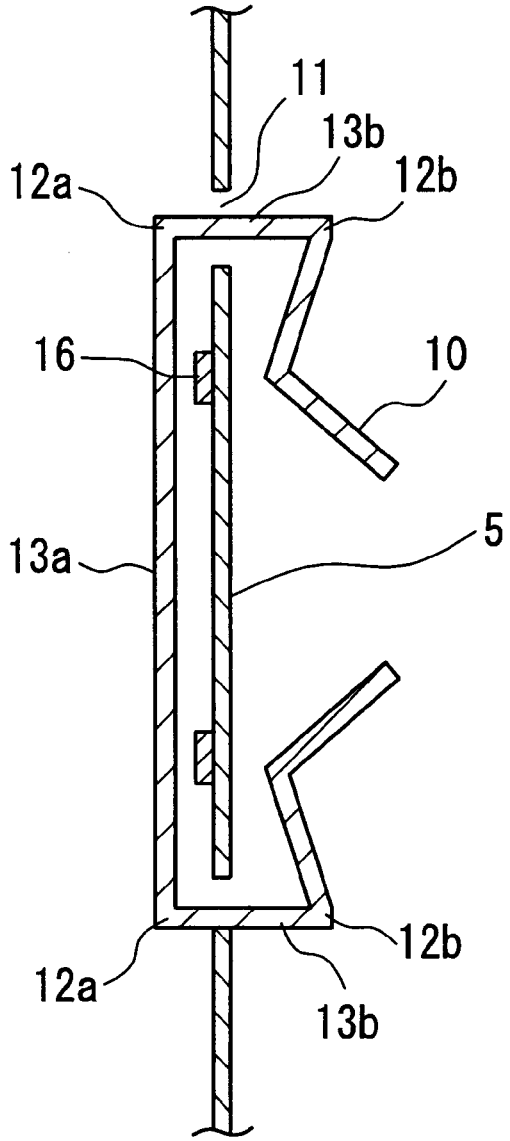
FIG. 5 is a cross-sectional view showing a vibration damping member and a shadow mask in a color cathode ray tube according to Embodiment 2 of the present invention.

FIG. 5 is a partial cross-sectional view showing Embodiment 2 of the present invention. This embodiment is different from Embodiment 1 in that a device for preventing a vibration damping member 10 from being pinned is provided on a shadow mask 5. The vibration damping member 10 is attached to the shadow mask 5 in such a manner that the vibration damping member 10 penetrates through two mounting apertures 11 and then are bent. At a region of the shadow mask 5 between the two mounting apertures 11, protrusions 16 protruding toward a bridge portion 13*a* of the vibration damping member 10 are provided. These protrusions 16 keep the bridge portion 13*a* of the vibration damping member 10 offset from the shadow mask 5. This configuration regulates a tilted angle of the vibration damping member 10 with respect to the face of the shadow mask 5, thus preventing a phenomenon in which a bending portion 12*a* or 12*b* is caught by the edge of the mounting aperture 11 so that the vibration damping member 10 is pinned by the shadow mask 5.

Note here that the shape and the number of the protrusions 16 are not limited especially. In addition, a length of the protrusions 16 along the bridge portion 13*a* may be lengthened so as to form a swelling portion. A method for manufacturing the protrusions 16 and the swelling portion is not limited especially, and they may be formed by attaching a different member to the shadow mask 5 by bonding, welding or the like, or may be formed by deforming the shadow mask 5 by press working or the like.

Embodiment 3

Figure 6:
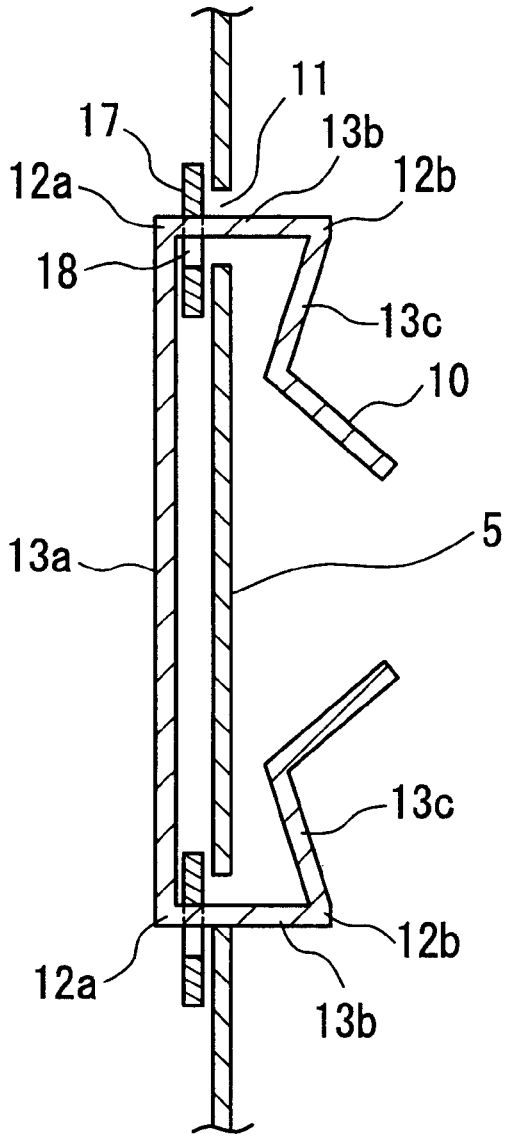
FIG. 6 is a cross-sectional view showing a vibration damping member and a shadow mask in a color cathode ray tube according to Embodiment 3 of the present invention.

FIG. 6 is a partial cross-sectional view showing Embodiment 3 of the present invention. This embodiment is different from Embodiments 1 and 2 in that a device for preventing a vibration damping member 10 from being pinned is provided as a member different from the vibration damping member 10 and a shadow mask 5. As shown in FIG. 6, after letting two penetrating portions 13*b* respectively penetrate through central openings 18 of two washers (members having an aperture) 17, the vibration damping member 10 is attached to the shadow mask 5 by penetrating through two mounting apertures 11 provided in the shadow mask 5 in a similar manner to that in Embodiment 1. It is preferable to make a diameter of the openings 18 of the washers 17 smaller than an aperture diameter of the mounting apertures 11. The washers 17 have an outer diameter and an aperture diameter set so as to be held by not a bridge portion 13*a* of the vibration damping member 10 but the penetrating portions 13*b*. In this way, by attaching the washers 17 to the vibration damping member 10 between the bridge portion 13*a* and the shadow mask 5 so as to overlap with the edges of the mounting apertures 11, the bridge portion 13*a* of the vibration damping member 10 is kept offset from the shadow mask 5 while maintaining a freely movable state of the vibration damping member 10. Thereby, a tilted angle of the vibration damping member 10 with respect to the face of the shadow mask 5 is regulated, thus preventing a phenomenon in which the bending portion 12*a* or 12*b* is caught by the edge of the mounting aperture 11 so that the vibration damping member 10 is pinned by the shadow mask 5.

It is preferable to make the aperture diameter of the openings 18 of the washers 17 larger than the outer diameter of the penetrating portions 13*b* of the vibration damping member 10. With this configuration, the washers 17 can be attached to the vibration damping member 10 so as to move freely with respect to the vibration damping member 10. As a result, since the washers 17 also exert a vibration damping function in addition to the vibration damping member, the vibration damping effect for the shadow mask 5 further can be enhanced. In addition, even if the bending portion 12*a* or 12*b* happens to be latched by the edge of the mounting aperture 11, the vibrations of the washers 17 can help alleviate the latching of the bending portion 12*a* or 12*b* by the edge of the mounting aperture 11.

Figure 7:
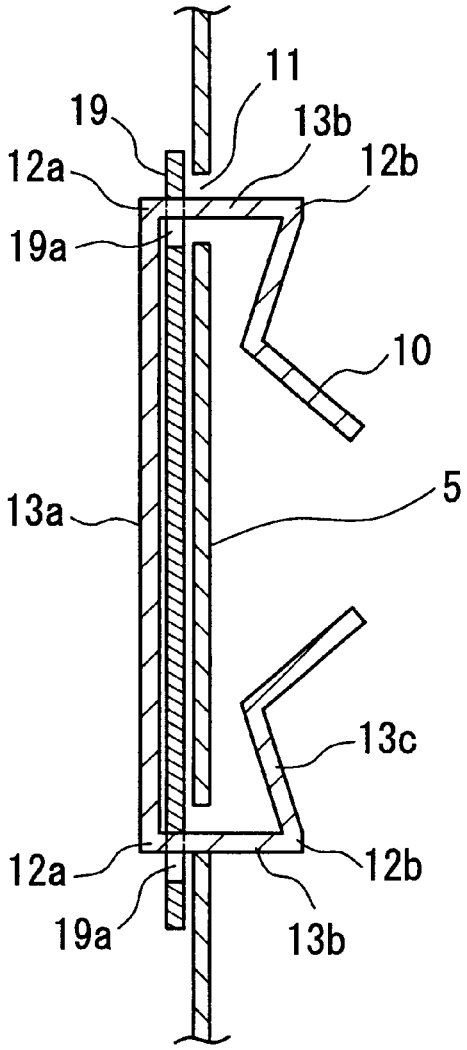
FIG. 7 is a cross-sectional view showing another configuration example of a vibration damping member and a shadow mask in a color cathode ray tube according to Embodiment 3 of the present invention.

As long as the bridge portion 13*a* can be kept offset from the shadow mask 5, the device provided as a different member for preventing latching and fixing is not limited to the washers 17 of FIG. 6. For example, as shown in FIG. 7, one flat plate 19 may be attached to the vibration damping member 10 in such a manner that a pair of penetrating portions 13*b* respectively penetrate through two openings 19*a* provided in the flat plate 19 and the flat plate 19 is positioned between the bridge portion 13*a* and the shadow mask 5. In this case also, by appropriately setting an aperture diameter of the pair of openings 19*a* of the flat plate 19 and a space between the openings, the flat plate 19 is attached to the vibration damping member 10 so as to move freely with respect to the vibration damping member 10.

Figure 8:
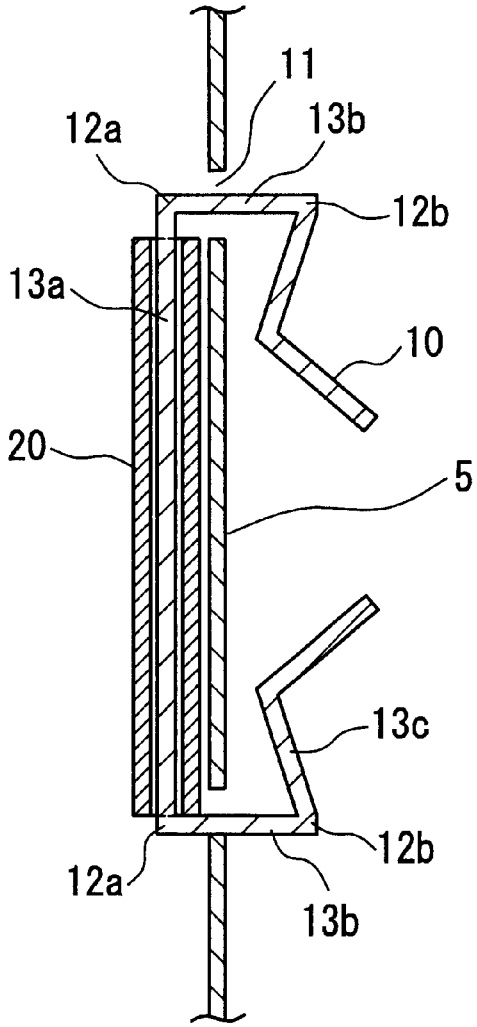
FIG. 8 is a cross-sectional view showing still another configuration example of a vibration damping member and a shadow mask in a color cathode ray tube according to Embodiment 3 of the present invention.

Alternatively, as shown in FIG. 8, a cylindrical hollow pipe 20 may be attached to the bridge portion 13*a* so that the bridge portion 13*a* penetrates through the hollow portion. In this case also, by appropriately setting an aperture diameter of the hollow portion and length of the pipe 20, the pipe 20 is attached to the vibration damping member 10 so as to move freely with respect to the vibration damping member 10. Note here that the number of the pipe that is attached to the bridge portion 13*a* is not limited to one, and a plurality of pipes may be attached.

Embodiment 4

Figure 9:
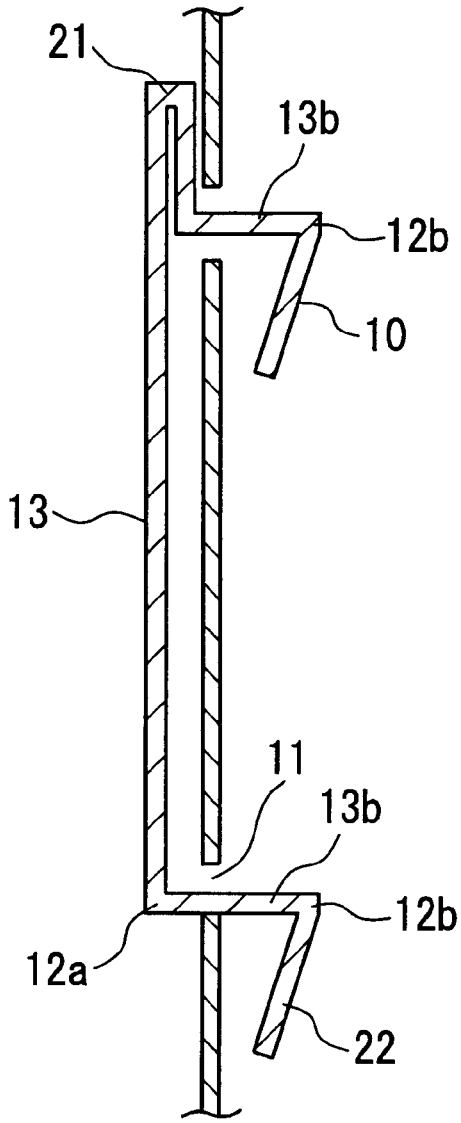
FIG. 9 is a cross-sectional view showing a vibration damping member and a shadow mask in a color cathode ray tube according to Embodiment 4 of the present invention.

FIG. 9 is a partial cross-sectional view showing Embodiment 4 of the present invention. This embodiment is different from Embodiments 1 to 3 in that the vibration damping member 10 has an asymmetrical shape with respect to the center position between a pair of penetrating portions 13*b*. That is to say, on the upper end side of the vibration damping member 10, one end 21 of a bridge portion 13*a* extends upward beyond the penetrating portion 13*b*, and on the lower end side, a portion 22 on the open end side is bent downward at a bending portion 12*b*. With this configuration, a tilted angle of the vibration damping member 10 with respect to the face of the shadow mask 5 is regulated, thus preventing a phenomenon in which the bending portion 12*a* or 12*b* is caught by the edge of the mounting aperture 11 so that the vibration damping member 10 is pinned by the shadow mask 5. Furthermore, a barycenter of the vibration damping member 10 is positioned out of the center position between the pair of penetrating portions 13*b*, which activates the motion of the vibration damping member 10 at the time of vibrations of the shadow mask 5, thus reducing the tendency for the vibration damping member 10 to be pinned by the shadow mask 5.

Note here that a shape of the vibration damping member 10 in this embodiment is not limited to the shape of FIG. 9, as long as it is an asymmetrical shape with respect to the center position between the pair of penetrating portions 13*b*.

Embodiment 5

Figure 10A:
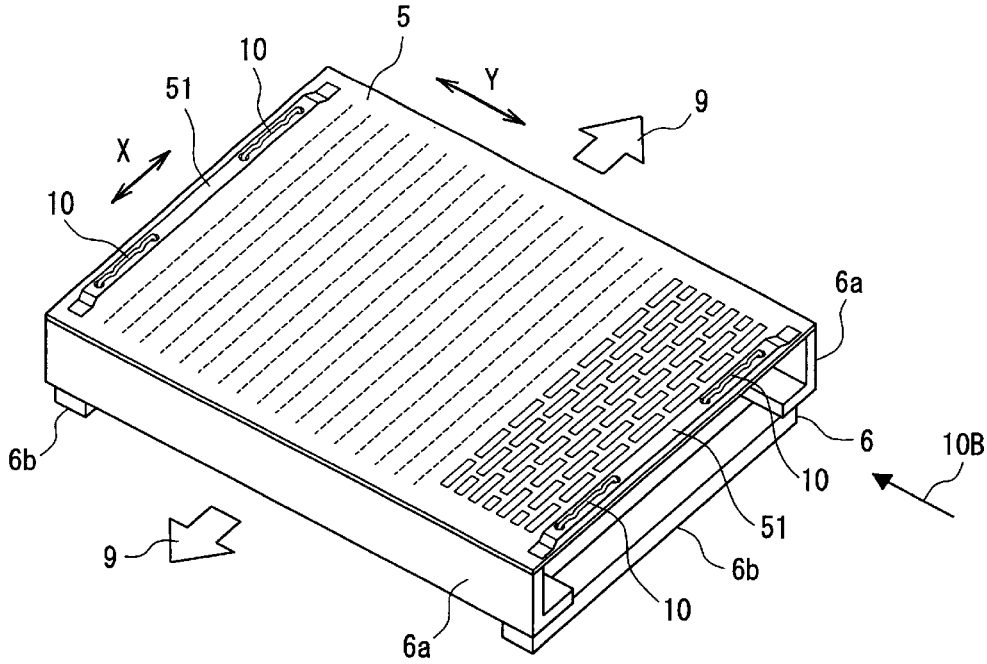
FIG. 10A is a schematic perspective view showing an assembled member of a shadow mask in a color cathode ray tube according to Embodiment 5 of the present invention.
Figure 10B:
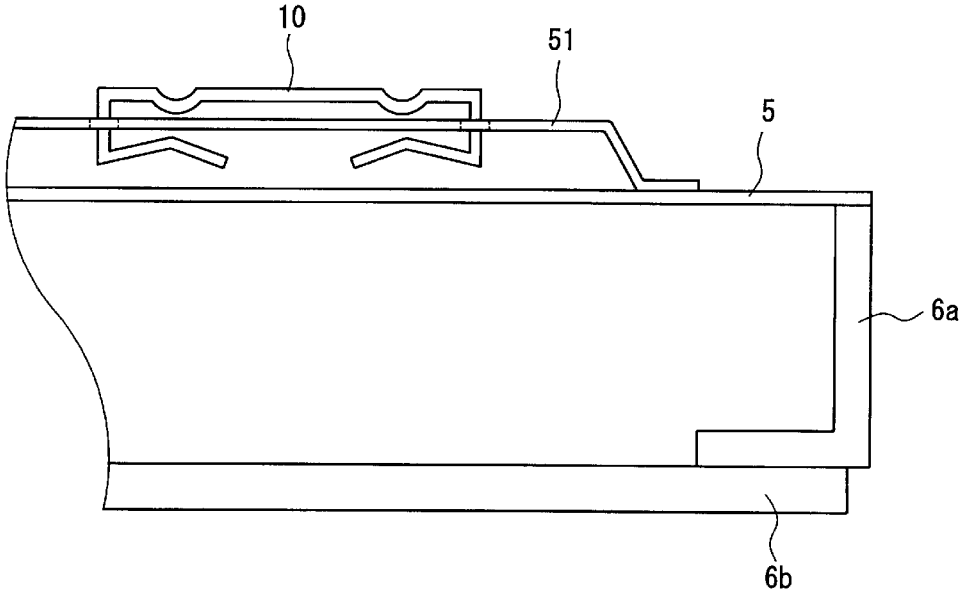
FIG. 10B is a partial side view of the shadow mask assembled member in the direction of the arrow 10B in FIG. 10A.
Figure 11:
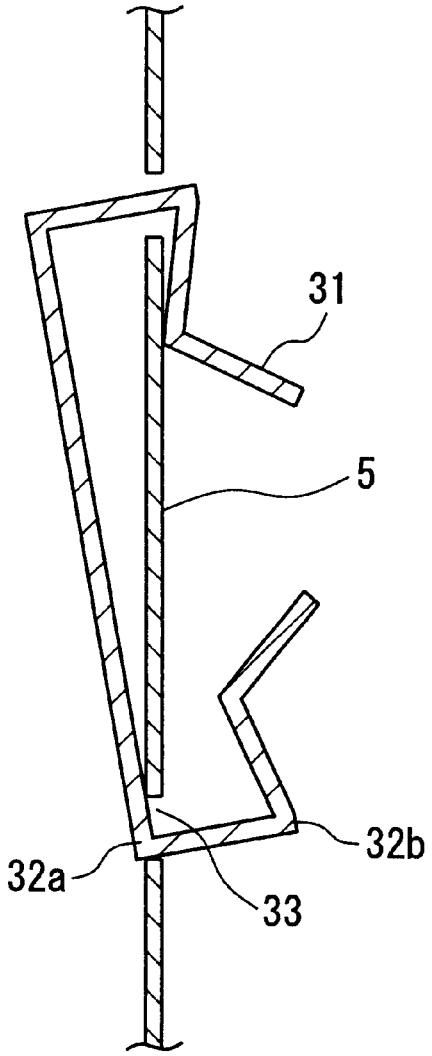
FIG. 11 PRIOR ART
FIG. 11 is a cross-sectional view showing a vibration damping member and a shadow mask in the conventional color cathode ray tube.

FIG. 10A is a schematic perspective view showing another example of a shadow mask assembled member to which the vibration damping member 10 according to the present invention is attached, and FIG. 10B is a partial side view of the shadow mask assembled member in the direction of the arrow 10B in FIG. 10A. This embodiment is different from the shadow mask assembled member shown in FIG. 3 in that the vibration damping member 10 is attached not to a shadow mask 5 but to a member 51. This difference will be described below.

As shown in FIGS. 10A and 10B, the member 51 is attached to the shadow mask 5 at a region on both outer sides in the horizontal direction, which is outside the region in which apertures through which electron beams pass are formed. As shown in FIG. 10B, the member 51 may be made of a strip-form metal plate. Both ends of the member 51 are bent so that a center portion thereof is apart from the shadow mask 5 and the member 51 is welded to the shadow mask 5 only at the both ends. The vibration damping member 10 penetrates through two mounting apertures (not illustrated) formed in the center portion of the member 51, which is apart from the shadow mask 5, so as to be attached to the member 51 in a freely movable state. The vibration damping member 10 does not contact with the shadow mask 5. When the shadow mask 5 vibrates, the member 51 also vibrates following the vibrations. At this time, the vibration damping member 10 functions so as to dampen the vibrations of the member 51, which also results in the dampening of the vibrations of the shadow mask 5. The vibration damping member 10 has the same configuration as described in Embodiment 1. Therefore, like Embodiment 1, this configuration can prevent a phenomenon in which the vibration damping member 10 is pinned by the member 51.

Note here that although FIGS. 10A and 10B show an example where the configuration of Embodiment 1 is applied to the member 51 for attaching the vibration damping member 10, the configurations of Embodiments 2 to 4 also are applicable, and in all cases, the same effects as above can be obtained. In the case of the application of Embodiment 2, the protrusions 16 (or the swelling portion) are provided not on the shadow mask 5 but on the member 51.

Further, as long as the member different from the shadow mask 5, to which the vibration damping member 10 is attached, is capable of being attached to the shadow mask 5 and vibrating following the vibrations of the shadow mask 5, such a member is not limited to the member 51 shown in FIGS. 10A and 10B.

Although the above-described Embodiments 1 to 5 deal with examples where two vibration damping members 10 are attached at each of the both end portions of the shadow mask 5 in the horizontal direction, the number and the size of the vibration damping member 10 may be changed as appropriate depending on the size of a color cathode ray tube and a tension distribution on the shadow mask 5.

Additionally, in the above-described Embodiments 1 to 5, the shape of the openings of the mounting apertures 11 is a circle, but the shape is not limited to this. For instance, at least one of the two mounting apertures corresponding to one vibration damping member 10 may be shaped as an ellipse, which facilitates the attachment of the vibration damping member 10.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color cathode ray tube comprising:

a shadow mask held in a state of tension applied thereto;

two mounting apertures provided in the shadow mask or a different member attached to the shadow mask, the different member vibrating following vibration of the shadow mask; and a vibration damping member penetrating through the two mounting apertures to be attached in a freely movable state to the shadow mask or the different member, the vibration damping member dampening vibration of the shadow mask, wherein the vibration damping member has two penetrating portions each passing loosely through one of the two mounting apertures and a bridge portion linking the two penetrating portions, and a protrusion or a swelling portion protruding toward the shadow mask or the different member is provided in the bridge portion.

2. The color cathode ray tube according to claim 1, wherein the two mounting apertures are provided in the shadow mask.

3. A color cathode ray tube comprising:

a shadow mask held in a state of tension applied thereto;

two mounting apertures provided in the shadow mask or a different member attached to the shadow mask, the different member vibrating following vibration of the shadow mask; and a vibration damping member penetrating through the two mounting apertures to be attached in a freely movable state to the shadow mask or the different member, the vibration damping member dampening vibration of the shadow mask, wherein a protrusion or a swelling portion protruding toward the vibration damping member is provided at a region between the two mounting apertures of the shadow mask or the different member.

4. The color cathode ray tube according to claim 3, wherein the two mounting apertures are provided in the shadow mask.

5. A color cathode ray tube comprising:

a shadow mask held in a state of tension applied thereto;

two mounting apertures provided in the shadow mask or a different member attached to the shadow mask, the different member vibrating following vibration of the shadow mask;

a vibration damping member penetrating through the two mounting apertures to be attached in a freely movable state to the shadow mask or the different member, the vibration damping member dampening vibration of the shadow mask; and a member having an aperture through which the vibration damping member penetrates and attached in a freely movable state to the vibration damping member.

6. The color cathode ray tube according to claim 5, wherein the two mounting apertures are provided in the shadow mask.

7. A color cathode ray tube comprising:

a shadow mask held in a state of tension applied thereto;

two mounting apertures provided in the shadow mask or a different member attached to the shadow mask, the different member vibrating following vibration of the shadow mask; and a vibration damping member penetrating through the two mounting apertures to be attached in a freely movable state to the shadow mask or the different member, the vibration damping member dampening vibration of the shadow mask, wherein the vibration damping member has two penetrating portions each passing loosely through one of the two mounting apertures, and the vibration damping member has an asymmetrical shape with respect to a center position between the two penetrating portions.

8. The color cathode ray tube according to claim 7, wherein the two mounting apertures are provided in the shadow mask.

* * * * *